United States Patent [19]

Hamada et al.

[11] 4,044,447

[45] Aug. 30, 1977

[54] METHOD OF SIMULTANEOUSLY DRAWING A NUMBER OF WIRE MEMBERS

[75] Inventors: Koichi Hamada, Tokyo; Kaoru Kikubu, Sakai; Tsunehiro Itoh, Hirakata, all of Japan

[73] Assignee: Nippon Seisen, Co., Ltd., Osaka, Japan

[21] Appl. No.: 231,152

[22] Filed: Mar. 7, 1972

[30] Foreign Application Priority Data

Mar. 2, 1971 Japan ..... 46-10864

[51] Int. Cl.[2] ..... B23P 17/00; B21C 1/00

[52] U.S. Cl. ..... 29/419 R; 29/423; 72/278

[58] Field of Search ..... 29/419; 72/274, 276, 72/278, 286, 179, 177

[56] References Cited

U.S. PATENT DOCUMENTS

| | | | |
|---|---|---|---|
| 2,050,298 | 8/1936 | Everett | 29/419 |
| 2,077,682 | 4/1937 | Everett | 29/419 |
| 3,154,846 | 11/1964 | Alexander | 72/177 |
| 3,223,878 | 12/1965 | Todd | 29/419 |
| 3,239,919 | 3/1966 | Levi | 29/419 |
| 3,370,347 | 2/1968 | Garwin et al. | 29/419 |
| 3,378,999 | 4/1968 | Roberts et al. | 29/419 |
| 3,523,354 | 8/1970 | Loewenstein | 29/419 |
| 3,540,114 | 11/1970 | Roberts et al. | 29/419 |
| 3,596,349 | 8/1971 | Boom | 29/599 |
| 3,618,205 | 11/1971 | Barber et al. | 29/419 |
| 3,643,304 | 2/1972 | Kokubu | 29/423 |
| 3,737,367 | 6/1973 | Roberts et al. | 29/419 |

*Primary Examiner*—Michael J. Keenan

*Attorney, Agent, or Firm*—Irving M. Weiner; Pamela S. Austin

[57] ABSTRACT

A number of wires are gathered together and bound with an armoring material in the shape of a band. The wires in this condition are drawn by means of a wire drawing apparatus having dies and a capstan. A plurality of bundles of such wires are gathered together and bound in the same way as in the foregoing to form a composite bundle body, which is further drawn, and these processes are repeated until at least filaments of a specified diameter are obtained in quantities.

7 Claims, 7 Drawing Figures

METHOD OF SIMULTANEOUSLY DRAWING A NUMBER OF WIRE MEMBERS

BACKGROUND OF THE INVENTION

1. Field of the Invention

This invention relates to a method and apparatus for drawing a plurality of filaments bound with an armoring material in the shape of a band, and thereby providing a plurality of leaner filaments, both efficiently and economically.

2. Description of the Prior Art

Some of the methods of obtaining from filaments of a given diameter those of a smaller diameter are mentioned herein. One is termed "single head wire drawing," wherein filaments of a given diameter are passed through a single die one by one to form filaments of a smaller diameter. Another method is called "continuous wire drawing," wherein an apparatus comprising a plurality of dies and capstans corresponding in number to such dies is utilized. Another method involves inserting a filament of a given diameter into a tubular body having a caliber conforming to the diameter of the filament to form an integrated double structure, which is then drawn; and a plurality of said double structures are inserted into a tubular body of a greater caliber to be drawn as in the foregoing, and thereafter the processes of insertion into said tubular body and drawing are repeated.

In the first two methods, drawing is effected after inserting one wire into one die. Consequently, not only a bulky device is required for mass production, but also such methods are unsuitable for obtaining the so-called "filaments" having minute diameters. There is a further disadvantage, characteristic of wire drawing machining in general, that the machining speeds are extremely low.

It is only natural that the last of the above-mentioned three methods is considered the most suited for filament molding and, in fact, is adopted for practical use to prove its efficiency to a certain extent. This method has disadvantages too. First, technical difficulties are inevitable in a process of inserting a wire material of a great length into an elongate tube having a caliber conforming to the peripheral shape of the wire material for integration. Secondly, as in the first two methods, a process of drawing a wire (of a double structure in this case) through one die is of utmost importance, entailing great technical difficulties yet unsolved in the case of mass production. Thirdly, in this method, the filament obtained is of complex, multiple layers, with the armoring tubular bodies succeedingly enveloping an inner one from the outside according to the number of times of wire drawing. The volume of the tubular bodies at the armoring removing step in the last process is too great as compared with the total volume of the filaments, with resultant waste in time and labor required for armor removal, and high cost needed for the armoring tubular bodies. This method is, therefore, by no means a money-saving one.

SUMMARY OF THE INVENTION

The present invention solves the problems of the conventional techniques. The primary object of the present invention is to make drawing molding of a number of filaments simultaneously, and more specifically to provide quantities of stainless steel filaments through an uncomplicated process and at low cost. Substantial uniformity in composition has to be maintained in the filament material and the armoring material in the shape of a band used for the main means of the invention, in order to prevent wire breakage due to differences in inner stress in a drawing process of steel filaments. The material wire members bound within an armoring material in the shape of a band has to be prevented from burning due to the frictional heat generated when these members pass through the dies in a drawing process of steel filaments.

The invention provides a method of simultaneously drawing a number of wire members, comprising the steps of enveloping a plurality of wire members with an armoring in the shape of a band thereby forming a bundle of the wire members, providing cold machinability to the bundle, drawing the bundle, and thereafter removing the armoring from the wire members.

The invention also provides a method of simultaneously drawing a number of stainless wire members, including the step of forming a bundle by tightly enveloping the stainless wire members and the ones plated in advance with such metals that hardly form compound metals with armoring in the shape of a band composed of medium carbon steel. Thereafter, cold machinability is provided by applying thermal treatment to the composite bundle. The bundle is then drawn, and thereafter the armoring and the plating layer is removed from the stainless wire members.

The present invention also provides a method of simultaneously drawing a number of wire members, including the step of tightly enveloping a plurality of wire members gathered substantially in parallel relative to one another with an armoring in the shape of a band to thereby form a bundle of wire members. Then, cold machinability is provided to such bundle. Thereafter, the bundle is drawn by means of dies, and then the armoring is removed from the wire members.

The present invention also provides an apparatus for simultaneously drawing a number of wire members. The apparatus includes a roll for molding a band-like armoring into the shape of a conduit. The apparatus also includes a grooved roll for converging a plurality of wire members to be substantially parallel relative to one another. There is also provided a roll for closing both sides of the armoring in the shape of a band to envelop the wire members. The apparatus also includes dies and a capstan.

DETAILED DESCRIPTION

Figure 1:
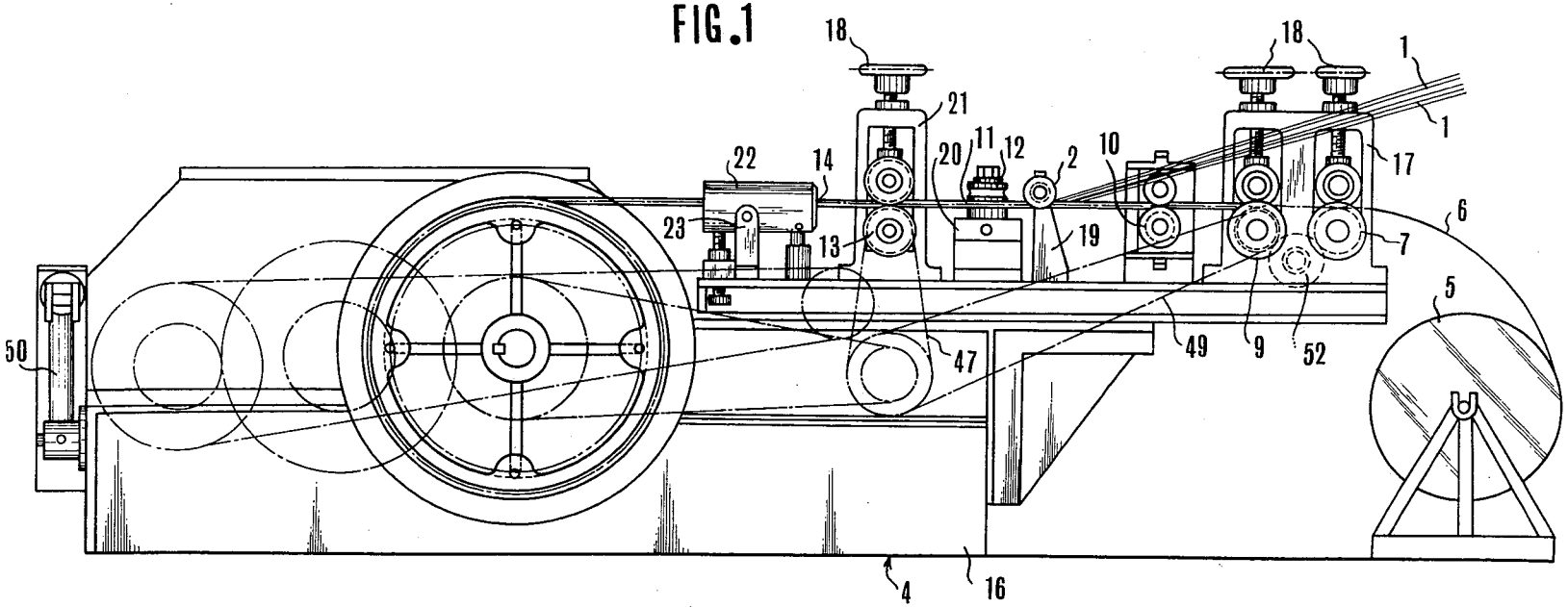
FIG. 1 is a front view of a molding wire drawing apparatus for making the first wire drawing of a bundle of members tightly enveloped with an armoring material in the shape or a band.
Figure 2:
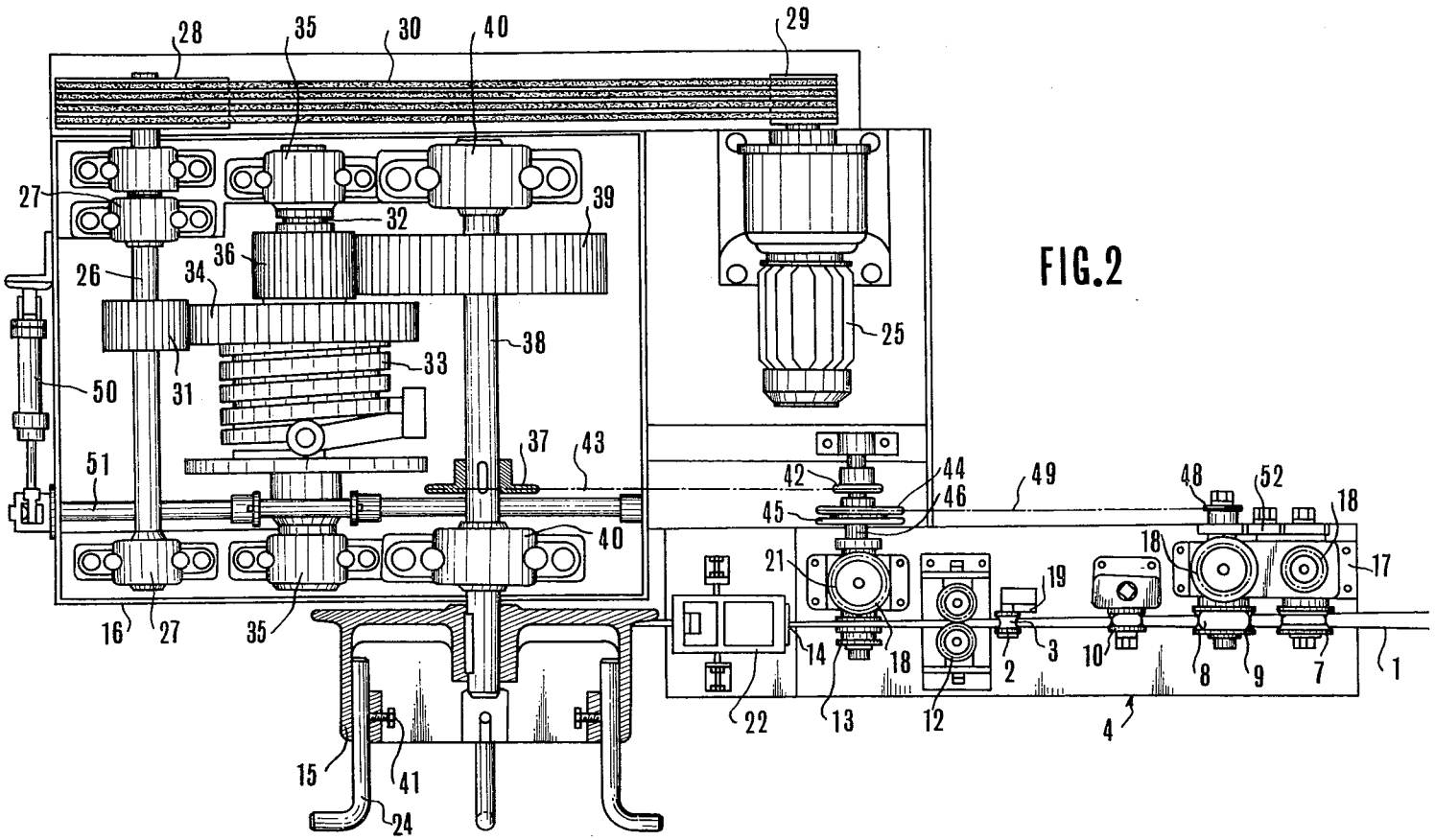
FIG. 2 is a plan view of the apparatus shown in FIG. 1.
Figure 3:
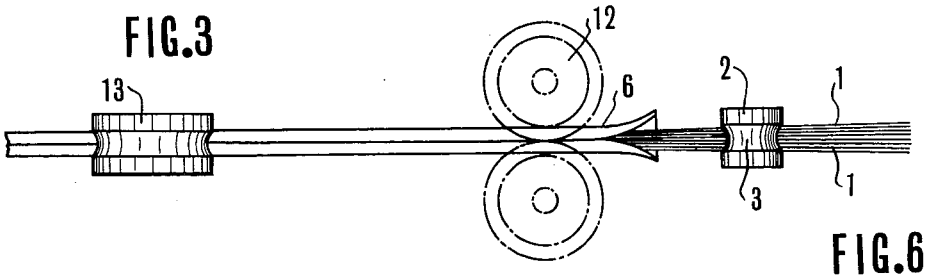
FIG. 3 is a plan view showing the condition in the vicinity of rolls in the preceding process of making a bundle of wire members by tightly enveloping them with an armoring material in the shape of a band.

The invention may be carried out primarily by the apparatus illustrated in FIGS. 1 and 2. This invention is characterized in that a bundle of a plurality of wire members, made by tightly enveloping them with an armoring material in the shape of a band, is drawn. The apparatus shown in FIGS. 1 and 2, therefore, is provided with mechanisms for making a bundle of the wire members with such armoring in the shape of a band, and for drawing the bundle. The process of making a bundle of wire members with an armoring in the shape of a band, and of drawing the bundle of the wire members thus formed will be explained in accordance with the attached drawings.

In FIG. 1 the material wire members 1 are previously made cold machinable, and are resepectively wound around reels (not shown) to be supplied by being drawn from such reels. The wire members 1 extracted from the reels are converged substantially in parallel relative to one another through groove 3 of converging roll 2.

Reel 5 is provided directly below the extremity of the device 4 through which the wire members 1 are extracted. A metal armoring 6 in the shape of a band previously provided with cold machinability is wound around said reel 5. The armoring is introduced into the device 4 while being held by a pair of insertion type guide rolls 7 with flat contact surfaces, and is passed through molding rolls 9 comprising paired wheels shaped so that their periphery is protruded outwardly and curved and a wheel having a curved groove 8 so as to pivotally support said first wheel. Then the armoring, curved so that both left and right edges are lifted in the longitudinal direction, is led to bending roll 10 which is similar to, but smaller than, the molding roll 9. The armoring 6 is further curved by the bending roll 10 into the shape of a conduit, supplied below the converging roll 2, and passes the converging roll 2 while receiving the wire members 1 from above.

Figure 4:
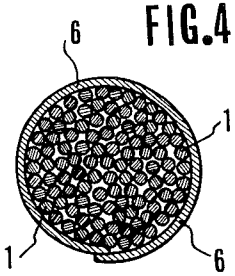
FIG. 4 is a cross sectional view of a bundle of wire members.

The armoring 6 in the shape of a band, thus formed and containing the focused wire members in its curved interior, is supplied to transverse squeezing roll 12, composed of two wheels having a curved groove 11 in their peripheries, where the bundle as shown in FIG. 4 is formed. This bundle is finished to a semi-perfect bundle by a longitudinal finishing roll 13 provided next to the squeezing roll 12 and having the same structure as the squeezing roll 12. The bundle thus finished is wound around capstan 15 through dies 14 provided next to the finishing roll 13, to be subjected to the first drawing process. The winding in this instance has to be made with sufficient care so that the both sides of the armoring 6 holding the wire members 1 within may not be opened. It is therefore required that the diameter of the capstan 15 be of the maximum possible length. The first drawing process is thus applied to the bundle, and cold machinability has to be previously provided to the armoring 6 and the wire members 1, not only for the first drawing process but for the succeeding drawing processes, too. The materials for the armoring 6 and the wire members 1 have to be selected carefully so that they will not be broken during the drawing operation. Research concerning a possible cause for such breaking confirms that the work hardening rate of a metal is related to its thermal treatment characteristic. From this the applicants proceeded to make a variety of experiments which resulted in a conclusion that the materials for the armoring 6 in the shape of a band and the wire members 1 have to be selected and their inner stresses adjusted so that their work hardening rates and thermal treatment characteristics are substantially coincidental. It has been further concluded that medium carbon steel is the most suitable for the armoring 6 when a wire drawing process, which is the ultimate aim of the present invention, is applied to stainless steel. The breaking problem is related to the degree of tightness with which the armoring 6 and the wire members 1 are fit together. Therefore, in a process in which the wire members 1 are enveloped with the armoring 6, the plurality of wire members 1 having the same diameter have to be gathered so as to be virtually in parallel with one another through the converging roll 2 as shown in FIGS. 1 and 2, to form a tight bundle in which the wire members are contacting one another in as much area as possible as illustrated in FIG. 4.

Figure 6:
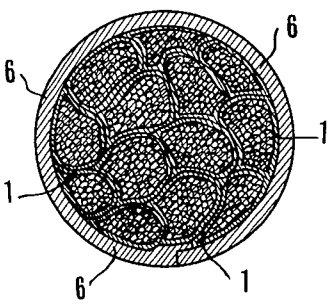
FIG. 6 is a cross sectional view of a drawn composite bundle.
Figure 5:
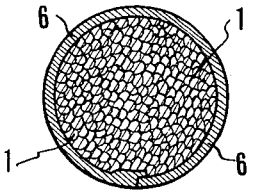
FIG. 5 is an enlarged cross sectional view of a drawn bundle.

Band-shaped armoring material of medium carbon steel is employed for the drawing process of stainless steel, as mentioned above. The wire members are adoptable in various cross-sectional shapes, such as circular, oval, plate-shaped, etc. When wire members in a variety of such shapes are utilized to form the composite bundle, as shown in FIG. 6, by being enveloped with armoring, the grooves of the molding roll 9, bending roll 10, and squeezing roll 12 as well as the hole in the dies 14 have to be selectively prepared. This has a bearing on the degree of correctness with which the armoring 6 and wire members 1 are fit together, so that sufficient care on this score is required in actual operation.

Figure 7:
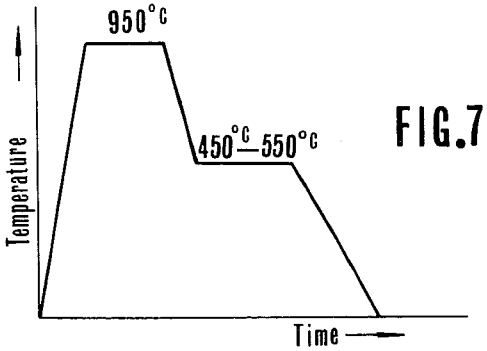
FIG. 7 is a graph showing the relation between temperature and time in the thermal treatment.

A considerable degree of deformation is applied to the armoring 6 and wire members 1, according to the present invention as mentioned above, so that cold machinability has to be provided to the armoring 6 and wire members 1 in order to make them accept said deformation. Such cold machinability may be provided through thermal treatment. Thermal treatment for such purpose, as in an embodiment of this invention described below, is made in accordance with the graph in FIG. 7 when medium carbon steel S300–S500 is employed for the armoring 6 and stainless steel SUS27 and other SUS material for the wire members 1. In other words, a patenting process is applied to the armoring 6 to form a sorbite system. In this instance an oxide film can be produced on the surface of the armoring 6 by performing a cooling process in the air. Such oxide film can serve as a lubricant when the armoring 6 is drawn by means of ordinary dies. That is, the cooling process is made in the air after thermal treatment, so that the inner system of the armoring 6 is turned into a sorbite system to achieve cold machinability, and simultaneously an oxide film is provided on its surface to make it lubricous. But a too rapid cooling after thermal treatment often results in failure of providing a perfect sorbite system to the armoring 6, so that a lead patenting process is desirable. That is to say that quenching should be made at more than $AC_3$ in an unoxidation atmosphere, and isothermal transformation with lead bath. A lead film attached on the surface of the armoring in this instance serves as a lubricant in the wire drawing operation by means of the dies. Thus, in lead patenting, cold machinability is provided to the armoring 6, which is made a nearly perfect sorbite system, and lubricity can also be acquired by virtue of lead coating. For effective realization of the present invention, however, care is needed so that the wire members 1 will not be burnt due to the heat generated during the drawing process. Accordingly, the thermal treatment has to be applied in a duly controlled oxidation atmosphere, such as a feeble oxidation atmosphere. Owing to the thermal treatment (including a succeeding cooling process) in said controlled oxidation atmosphere (a feeble oxidation atmosphere), oxide films can be produced on the surfaces of the wire members 1 too. The wire members 1 are thus prevented from being burnt due to heat as they lose their activity on their surfaces. In short, such thermal treatment has to be applied with sufficient care so that no ill effects will be given to the wire members 1, and that the cooling will not be too rapid.

As the method for preventing the wire members 1 from being burnt due to heat, in the present invention, for instance, plating in advance the wire members 1 with a plating material, such as copper, nickel, etc., is also effective.

The bundle, having thus undergone such a cold machining treatment, is then subjected to a drawing process by means of dies. Ordinary dies are suitable in the present invention, but roll dies may also be employed.

The drawing process is made by means of a wire drawing machine comprising a capstan and dies having sufficient capability of drawing a bundle of wires. In the drawing process, the wire drawing velocity has to be controlled according to the selective combination of the armoring 6 and the wire members 1. The cross section of the extracted bundle body is such that the wire members 1 are compressed from outside to be deformed and tightly bound together with their diameters contracting, and that the superposed extremities of the armoring 6 are forced into an integral whole; and the bundle as a whole makes up a filament of a smaller diameter than before. In the drawing process for the purpose of filament molding, for example, the blank is not drawn at a stretch until a predetermined filament diameter is obtained; but the drawing process is reiterated with intervening patenting treatment, annealing, and lubrication treatment applied to the armoring 6, while sufficient care is being taken so as to give no ill effects to the wire members 1, until at last the predetermined filament diameter is obtained.

After the wire members 1 have been formed into a filament of a given diameter, the armoring 6 and the wire members 1 are separated. A mechanical method may be employed for such separation, but a chemical method is more desirable in case of a filament having a minute diameter.

The present invention is materialized in a device illustrated in FIGS. 1 and 2, and explanation on said device is given in the following:

Dies and rolls for making guide machining of the armoring 6 and the wire members 1, etc., are mounted on bed 16 as shown in FIG. 1. Roll 7 of the aforementioned rolls is a guide roll, supported by the case 17 as the molding roll 9, with one of the wheels provided so as to be adjustable in the vertical direction by handle 18. The molding roll 9 and bending roll 10 are provided in the same way. The converging roll 2 is supported by arm 19, and the squeezing roll 12 is adjustably laid on roll base 20.

The finishing roll 13 is supported by case 21, one of the wheels thereof being adjustable by the handle 18.

The dies 14 are stored in dies box 22, which is mounted on the bed 16 by means of fixing lever 23.

In installing such rolls and dies, extra care should be taken so that the grooves of the rolls and the hole of the dies are provided on a semi-rectilinear line. Circular capstan 15 of a large diameter is provided in such a way that the circumference thereof contacts the extension of a line connecting the grooves and hole of the rolls and dies thus arranged.

Motor 25 provides a means for driving said rolls and capstan. Drive shaft 26 is pivotally supported by bearings 27 and has a pulley 28 which is connected to pulley 29 of the motor 25 through belt 30. Drive gear 31 is secured to the drive shaft 26. The drive gear 31 is engaged with clutch gear 34 which is supported by clutch shaft 32 and connected with spring clutch 33. Bearings 35 in FIG. 2 pivotally support the clutch shaft 32. The clutch shaft 32 is provided with an intermediate gear 36 which is detachable with respect to the clutch gear 34 through the clutch shaft 32. The intermediate gear 36 is engaged with driven gear 39 on driven shaft 38 which has capstan 15 at one end and the sprocket 37 at the middle portion thereof. Bearings 40 in FIG. 2 pivotally support the driven shaft 38. The capstan 15 has its body proper formed in the shape of a wheel, and has an auxiliary bar 24 in the shape of a letter "L" fixed to its inner surface by means of screw handle 41 said bar protruding at the outer edge of the capstan 15.

The sprocket 37 is connected by a chain 43 to sprocket 42 which is pivotally supported and projecting athwart from right below the finishing roll 13. The sprocket 42 is provided on the same shaft as the sprockets 44 and 45. The sprocket 45 is connected by chain 47 to the sprocket 46 secured on the same shaft as the finishing roll 13. The sprocket 44 is connected by chain 49 to the sprocket 48 which is provided integrally with and is fixed on the same shaft as the molding roll 9.

There is also provided a clutch operating device 50, a clutch operation lever 51, and a connecting gear device 52.

With regard to the operation of the device in FIGS. 1 and 2, the rotation of the motor 25 is transferred to the pulley 28 through the belt 30. The drive shaft 26 is rotated by the rotation of the pulley 28, and consequently the drive gear 31 which is fixed to the drive shaft 26 is then rotated. Since the drive gear 31 is engaged with the clutch gear 34, the clutch gear 34 is then rotated. If, in this instance, the clutch gear 34 and intermediate gear 36 are geared and integrated by the operation of the spring clutch 33 due to the clutch operation device 50, then torque is transferred to the driven gear 39 engaged with the intermediate gear 36. In this matter, the driven shaft 38 and then the capstan 15 and sprocket 37 are rotated, the rotation of the sprocket 37 being transferred to the sprocket 42 through the chain 43 and then to the sprockets 44 and 45 provided on the same shaft as the sprocket 42. The rotation of the sprocket 45 is transferred to the sprocket 46 of the finishing roll 13 through the chain 47 to drive the finishing roll 13. The rotation of the sprocket 44 is transferred to the sprocket 48 of the molding roll 9 through the chain 49 to drive the molding roll 9; and the guide roll 7 is driven by the connecting gear device.

Thus, the wire members 1 introduced by the guide roll 7 pass through the rolls and dies to be wound compulsorily by the capstan 15.

To attain some of the advantages of the present invention, the wire drawing by the dies is applied to a bundle of wire members made by tightly enveloping them with an armoring in the shape of a band, so that a number of drawn filaments are obtainable in one drawing process. Especially, by the use of armorings in the shape of a band, the invention allows efficient mass production, unlike the conventional methods of applying wire members to dies one by one and of inserting a wire member into a tubular body and enveloping a plurality of the tubular bodies with that of a larger diameter for drawings. The technical difficulties in inserting a wire member into a tubular body in the second conventional method have been eliminated too. One of the characteristics of the present invention is that drawing is made to long wire members continuously enveloped with an armoring in the shape of a band, so that longer filaments are obtainable than by conventional methods. Another characteristic of the present invention is that diameters convenient for handling in actual machining can be maintained due to the above-stated reason and that the wire members can be substantially carried by the armoring even when the filament has become thin to a considerable degree. Consequently, a filament of an extremely minute diameter can be molded.

Also, according to the present invention, a number of wire members are enveloped with a single-layer armoring, so that no unduly long time is required for removing the armoring from the wire members as compared with conventional methods, and therefore efficient machining operation is insured.

In this invention, medium carbon steel, having substantially the same work hardening rate and thermal treatment characteristic as the stainless steel wire employed as wire members, is adopted as armoring material so that the wire members and armoring are substantially uniform in composition, besides being tightly fitted relative each other. Therefore, any breaking due to a difference between inner stresses is prevented. Also, oxide films are produced on the surfaces of the wire members through thermal treatment in an oxidation atmosphere. Mutual burning of the wire members in a drawing process is therefore prevented, and a perfect filament in which the wire members are not welded relative to one another can be obtained.

Three embodiments of the invention are described below.

The first embodiment is related to a method of producing brushes of stainless steel wire, by employing medium carbon steel S45C with a cross section of 0.8 × 15 $mm^2$ for the armoring 6 in the shape of a band, and 0.6 mm stainless steel wire SUS27 for the wire members 1. All of the stainless steel wires are extracted from 20 reels and gathered into a bundle, and made to pass through the converging roll 2 and bound so as to be substantially in parallel with one another. The armoring 6, on the other hand, wound around the reel 5 is introduced by the guide roll 7, made to pass through the molding roll 9 and the bending roll 10 to be molded into the shape of an upward-looking conduit, and supplied so as to accept the wire members 1 in parallel with the wire members 1.

Therefore, the twenty wire members 1 and the armoring 6 are made to advance through the wire drawing apparatus at the same speed.

The 20 wire members 1 and the band-shaped medium carbon steel armoring 6 pass through the dies 14 having a 5.0 mm caliber in the parallel condition, forming a bundle of approximately 5.0 mm as they pass through the dies 14. The speed at which the armoring 6 and wire members 1 advance at that time is set at 2 m per minute.

An air patenting treatment from 950° C in an oxidation atmosphere is applied to the bundle thus obtained; and cold machinability and lubricity are provided to the armoring 6, and oxide films are formed on the surfaces of the wire members 1.

The bundle, further applied to the wire drawing apparatus having suitably selected dies, is drawn with an average cross-sectional decrease rate of 10%, and further drawn by stress removing low temperature annealing under high tension and at a speed of 5 m per minute and at 600° C. This procedure is reiterated, with 75% of total machining rate from one annealing to the next annealing process. The bundle is cut into pieces of 120 cm, 50 of said pieces being bound together. Their medium carbon steel armoring is dissolved away in a solution containing 20% nitric acid. Then, the oxide films of the wire members 1 are removed with fluoronitric acid.

In a second typical embodiment, a bundle with an outer diameter of 5 mm is composed of armoring 6 in the shape of a band and 300 wire members 1 each having a diameter of 0.1 mm. The thermal treatment and drawing processes are applied to the bundle in an oxidation atmosphere as in the preceding embodiment. The annealing and drawing processes are repeated six times and when the outer diameter has become 3 mm, the armoring is removed from the wire members 1 in the same way as in the foregoing embodiment, to obtain a filament having a diameter of approximately 7 microns.

In a third embodiment, a bundle with an outer diameter of 5 mm is composed of armoring 6 in the shape of a band after nickel plating with 300 stainless wire members 1 each having a diameter of 0.1 mm and then the thermal treatment and drawing processes are applied to the bundle in an oxidation atmosphere. The annealing and drawing processes are repeated six times and when the outer diameter of the bundle has become 3 mm, the armoring and the plating layer are removed from the wire members 1 in in the same way as in the foregoing embodiment, to obtain a filament having a diameter of approximately 7 microns.

We claim:

1. In a method for manufacturing filament of the type comprising gathering and bundling a plurality of wire members in parallel relationship to one another while feeding said wire members in a predetermined direction, feeding a band-shaped armoring of medium carbon steel out of a reel in parallel with said bundled wire members, said band-shaped armoring being formed into the shape of an upwardly directed conduit, storing the gathered plurality of wire members within said armoring formed into the shape of a conduit such that each wire member is parallel to the longitudinal axis of said conduit, enveloping said wire members in said conduit by closing said armoring such that said wire members are compressed by forces exerted by said armoring, thus tightly binding said wire members together forming an enveloped bundle of said wire members, drawing said enveloped bundle by means of dies, and removing said armoring from said wire members, the improvement which comprises:

plating in advance the wire members with a plating material.

2. The method of claim 1 wherein the plating material is either copper or nickel.

3. The method of claim 2 wherein the plating material is copper.

4. A method substantially as set forth in claim 1 including the steps of:

providing cold machinability to said bundle by applying at least one thermotreatment to said bundle in an oxidation atmosphere; and producing at least one oxide film on the surface of said wire members.

5. A method substantially as set forth in claim 1, including the step of:

forming said armoring into the shape of a conduit by means of a roll.

6. A method according to claim 1, including the step of:

extracting said enveloped bundle from said dies by means of a capstan.

7. A method for manufacturing stainless filament, comprising the steps of:

plating a plurality of wire members with a plating material;

bundling the plurality of stainless wire members in a parallel arrangement while feeding said stainless wire members in a predetermined direction;

feeding a band-shped armoring of medium carbon steel out of a reel in parallel with said bundled stainless wire members which are being fed in said predetermined direction, said band-shaped armoring being formed into the shape of an upwardly directed conduit;

feeding the bundle of substantially parallel arranged stainless wire members into said conduit-shaped armoring;

enveloping said wire members in said conduit by closing said armoring such that said wire members are compressed by forces exerted by said armoring, thus tightly binding said wire members together forming an enveloped bundle of said wire members;

drawing said enveloped bundle of said wire members by means of dies;

preparing a plurality of such enveloped bundles of wire members through the same procedure in accordance with the preceding steps;

sheathing the plurality of bundles of wire members with a band-shaped armoring of medium carbon steel;

drawing said sheathed bundles of wire members;

removing said armoring from said wire members.

* * * * *